US008534358B2

(12) United States Patent
Mauduit et al.

(10) Patent No.: US 8,534,358 B2
(45) Date of Patent: Sep. 17, 2013

(54) METHOD FOR HEATING A HYDROCARBON RESERVOIR

(75) Inventors: Dominique Mauduit, Idron (FR); Bruno Marty, legal representative, Pau (FR); Pierre Lemetayer, Pau (FR); Emmanuel Toguem Nguete, Pau (FR)

(73) Assignee: Total S.A., Courbevoie (FR)

( * ) Notice: Subject to any disclaimer, the term of this patent is extended or adjusted under 35 U.S.C. 154(b) by 491 days.

(21) Appl. No.: 12/644,843

(22) Filed: Dec. 22, 2009

(65) Prior Publication Data

US 2010/0200223 A1 Aug. 12, 2010

(30) Foreign Application Priority Data

Dec. 22, 2008 (FR) ..... 08 07374

(51) Int. Cl.
*E21B 43/24* (2006.01)
*E21B 36/00* (2006.01)

(52) U.S. Cl.
USPC ..... 166/303; 166/252.1; 166/272.3

(58) Field of Classification Search
USPC ..... 166/252.1, 250.06, 272.3, 303
See application file for complete search history.

(56) References Cited

U.S. PATENT DOCUMENTS 3,873,238 A 3/1975 Elfarr
4,020,901 A 5/1977 Pisio
4,299,278 A 11/1981 Beehler
5,215,149 A 6/1993 Lu
5,607,018 A 3/1997 Schuh
5,931,230 A * 8/1999 Lesage et al. ..... 166/303
6,293,341 B1 * 9/2001 Lemetayer ..... 166/250.15
2007/0199696 A1 8/2007 Walford

OTHER PUBLICATIONS

French Search Report in related French Application No. 0807374, dated Jul. 22, 2009, 6 pages.

* cited by examiner

*Primary Examiner* — David Andrews
*Assistant Examiner* — Richard Alker
(74) *Attorney, Agent, or Firm* — Polsinelli PC

(57) ABSTRACT

A method is proposed for heating a hydrocarbons reservoir, comprising the provision of an installation comprising:

Figure 1:
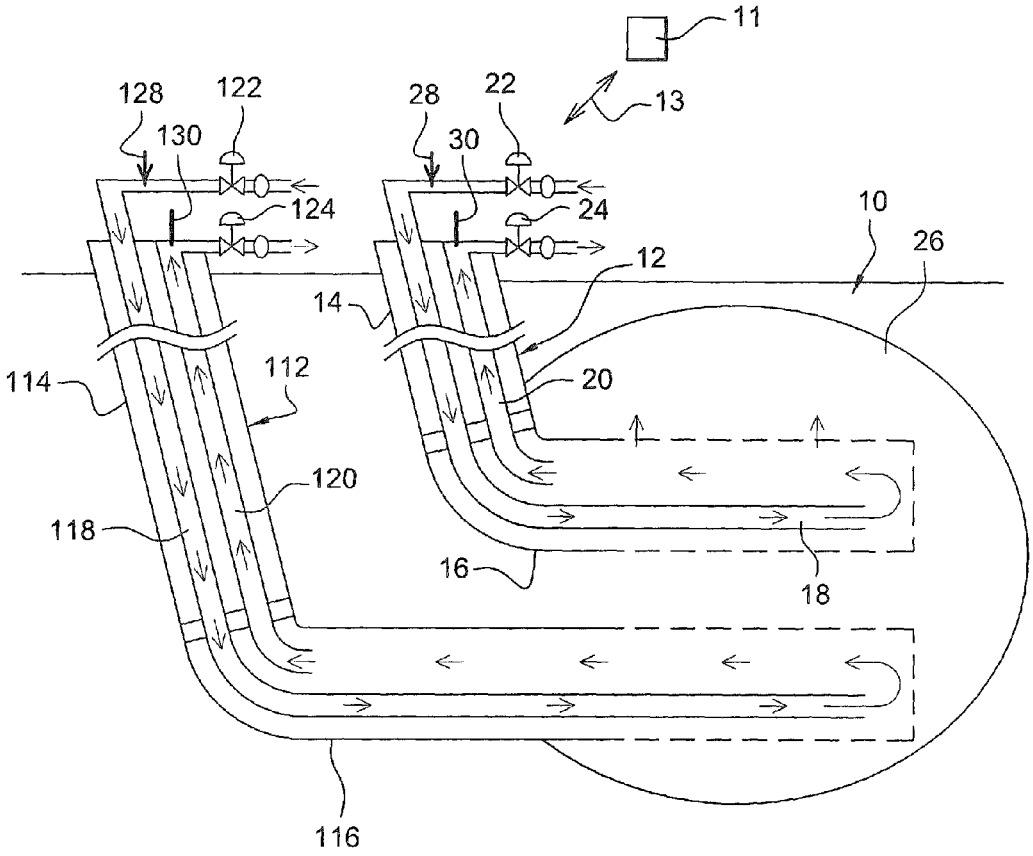

a first wellbore equipped with an injection string fitted with an adjustable choke and an extraction string fitted with an adjustable choke, a set of sensors, intended to measure physical variables, an automatic device making it possible to control and monitor the operation of the installation;

the circulation of steam from one string to the other; the control of the steam injection flow rate in function of a target value;

the keeping of a set of physical variables within a predetermined range of values by continuous action of the automatic device on the choke of the injection string, and on the choke of the extraction string.

The method makes it possible to more precisely control injection of the steam into the wellbore, throughout the circulation phase, optimizing the steam injection flow rate throughout the circulation phase while still ensuring the safe operation of the steam circulation phase.

16 Claims, 2 Drawing Sheets

METHOD FOR HEATING A HYDROCARBON RESERVOIR

BACKGROUND OF THE INVENTION

A method is proposed for heating a hydrocarbons reservoir with a view to their extraction. The reservoir comprises in particular heavy oils, i.e. oils which are not very, or not at all, mobile. A distinction is drawn between several thermal assisted recovery methods. For example the "huff and puff" process, also called CSS ("Cyclic Steam Soaking") described in the application U.S. Pat. No. 4,116,275 is a recovery method assisted by cyclic steam injection. This process uses a single wellbore and consists of three stages, repeated several times in succession: the steam is firstly injected via a wellbore (typically over a few weeks). This is followed by a period of a few days of soaking during which the steam condenses and passes its heat to the reservoir. Then comes the period of production via the same wellbore (from a few weeks to a few months). The wellbores are equipped with a bottom pump to remove the product.

Gravity drainage recovery methods have also been proposed, for example SAGD (Steam Assisted Gravity Drainage). The SAGD process involves drilling 2 parallel horizontal wellbores, one approximately five meters below the other. Steam is injected continuously through the upper wellbore. The injected steam heats the formation. If the permeability is sufficient, the liquefied bitumen and the water resulting from the condensation of the steam flow by gravity as far as the lower wellbore. The drained zone forms a "steam chamber" which expands as the bitumen is extracted. The oil produced is then replaced, in the formation, by the injected steam.

The methods of recovery by injection of a hot fluid comprise a first stage which involves circulating steam in the wellbores, so as to heat the reservoir around the wellbores. During this circulation phase, the injected steam condenses on the inner walls of the wellbore, which are initially cold. While condensing, the steam releases its latent heat and thus heats the inner walls of the wellbore. The heat is then transmitted by conduction to the part of the formation situated in the immediate proximity of the wellbore.

A satisfactory operation of the circulation phase is necessary to heat the reservoir homogeneously, and thus subsequently to allow an optimum production of hydrocarbons.

It is for example necessary, for safety reasons, to keep a bottom pressure below a limit value, which can for example be the fracturing pressure. The fracturing pressure is specific to each deposit and can vary typically from 10 to 150 bar. It is also desirable to limit the production of hydrocarbons during the circulation phase. In fact, the hydrocarbons would then be produced mixed with the condensates, i.e. in the form of an emulsion, which is harmful to the installation. In the case where the installation comprises several horizontal wellbores (case of a SAGD type configuration), it is also necessary to avoid the creation of preferential paths between the wellbores. Finally, the circulation phase must be relatively short, in order to allow the operators to rapidly access the production phase.

Moreover, as the circulation phase proceeds, constraints develop, in particular the bottom-pressure constraint. The bottom pressure depends on the reservoir, the weight of the column of liquid in the wellbore, and the steam injection pressure. At the start of the circulation phase, the injected steam has a tendency to condense on the walls of the strings: the extraction string is thus partially filled with a liquid condensate. As the bottom pressure depends on the weight of the column of liquid in the wellbore, there is a high bottom-pressure constraint at the start of the circulation phase: a small increase in the steam injection pressure makes it possible to reach the fracturing pressure. When the steam circulates in the injection and extraction string in gaseous form only, the bottom pressure falls for the same injected steam pressure. It is then possible to increase the steam injection pressure without the risk of reaching the fracturing pressure.

Control of the circulation phase is disclosed in several applications.

The process disclosed in application U.S. Pat. No. 5,931,230 is of the "huff and puff" type, with a wellbore equipped with a long string and a short string. Steam is circulated between the long string and the short string. Once the wellbore is in place, the hydrocarbons are heated by the continuous circulation of the steam as far as the horizontal part of the wellbore at a pressure below the fracturing pressure. While the steam is circulated, the steam injection pressure and the steam circulation flow rate (and thus, the bottom pressure in the wellbore) can be controlled by adjustable chokes situated at the surface on the injection string. However, this document does not say how the control is carried out.

The document U.S. Pat. No. 7,147,057 describes a recovery method comprising 2 partly horizontal wellbores, arranged one above the other and in which the steam circulates mainly in a closed circuit in the upper wellbore. This circuit is constituted by a looped conduit, with an inlet and an outlet at the wellhead. The steam circulation in the wellbore takes place via this conduit. Steam is injected into the upper wellbore at the conduit inlet. On contact with the cold walls of the conduit, the steam condenses and transmits its latent heat to the conduit, which is thus heated. Another conduit is provided at the lower wellbore, in which the hydrocarbon condensates are recovered. Valves are provided on the circulation system, so as to pass the steam into the formation under certain conditions in order to produce a steam chamber. During a first stage, which corresponds to the circulation phase, the valves are closed and the system operates in closed circuit. The circulation of the steam is continued until the temperature of the wellbore is at least equal to a determined temperature, for example the boiling point of water, which corresponds to a circulation in the form of steam throughout the circuit, without condensation of the steam on the walls.

As from this moment, the valves provided on the circulation device are opened, and the steam can then pass into the formation. The opening of the valves can be triggered by the temperature of the steam.

This device therefore makes it possible to control the quantity of steam entering the formation. However, it requires a specific string, i.e. with valves making it possible to control the injection of steam into the formation. The device described in the application U.S. Pat. No. 7,147,057 is a complex device, which will involve maintenance operations at the bottom of the wellbore, and a production shutdown in order to carry out these maintenance operations.

For the methods of recovery by injection of a hot fluid, there is therefore a need for a more precise control of the injection of the steam into the wellbore throughout the circulation phase, optimizing the steam injection flow rate throughout the circulation phase while still ensuring the safe operation of the steam circulation phase.

SUMMARY OF THE INVENTION

For this, a method is proposed for heating a hydrocarbons reservoir, comprising:

the provision of an installation comprising:

a first wellbore equipped with an injection string fitted with an adjustable choke and an extraction string fitted with an adjustable choke, a set of sensors, intended to measure physical variables, an automatic device making it possible to control and monitor the operation of the installation;

the circulation of steam from one string to the other;

the control of the steam injection flow rate in relation to a target value;

the keeping of a set of physical variables within a predetermined range of values by continuous action of the automatic device on the choke of the injection string, and on the choke of the extraction string.

According to another feature, if the physical variables lie outside the ranges of values defined for each of these physical variables, the automatic device causes the installation to shut down.

According to another feature, the physical variables are chosen from the group comprising the bottom pressure in the wellbore, the steam flow rate, measured on the injection string, the steam flow rate measured by a sensor on the extraction string, the steam pressure, the temperature at the injection string, the temperature at the extraction string, and the difference between these temperatures.

According to another feature, the bottom pressure is measured by a sensor or calculated from measurements carried out at the surface.

According to another feature, the bottom pressure in the wellbore is below the fracture pressure of the reservoir.

According to another feature, the process comprises a steaming stage during which the physical variables are in particular:

the fluid extraction flow rate, which is kept above a predetermined value;

the bottom pressure, which is kept below a critical value.

According to another feature, the automatic device acts continuously on the choke of the injection string so as to reach a target pressure, without the bottom pressure in the wellbore exceeding the predetermined value, and without the steam injection flow rate measured at the injection string being above the critical value.

According to another feature, during the steam application stage, a condensed water removal gas is also circulated in the wellbore around the strings.

According to another feature, the condensed water is pumped.

According to another feature, the process comprises a stage of creating a heat chamber, during which the physical variables are in particular:

the pressure measured at the extraction string, which is kept above a predetermined value;

the bottom pressure, which is kept below a critical value.

According to another feature, the automatic device also calculates the difference between the pressure measured at the injection string and the pressure measured at the extraction string, and keeps this difference above a predetermined threshold by continuous action on the choke of the injection string and on the choke of the extraction string.

According to another feature, the automatic device also calculates the difference between the fluid flow rate measured at the injection string and the fluid flow rate measured at the extraction string, and keeps this difference above a predetermined threshold by continuous action on the choke of the injection string and on the choke of the extraction string.

According to another feature, the two strings are parallel or concentric.

According to another feature, the steam is circulated from the longer string to the shorter string.

According to another feature, the process also comprises:

the provision of a second wellbore comprising an injection string with a control choke and an extraction string with a control choke, the injection string being longer than the extraction string and the second wellbore being situated under the first wellbore in the reservoir;

the calculation by the automatic device of the difference in pressure between the first wellbore and the second wellbore;

the keeping of this difference between a minimum threshold and a maximum threshold by continuous action of the automatic device on the chokes of the injection strings, and on the chokes of the extraction strings of the wellbores.

According to another feature, the process comprises a stage of monitoring the fulfillment of at least one criterion from among a criterion of reaching a predetermined volume of injected steam, a criterion of duration of steam injection, a criterion of bottom pressure in the wellbore, a criterion of temperature, a criterion of reaching a certain flow rate of liquid in the extraction string of the second wellbore, a criterion of reaching a difference in temperature between the two strings of each wellbore, a criterion of water content in the liquid produced.

According to another feature, the automatic device calculates at least one variable, from among the total volume of steam injected at the injection string, the difference in temperature between the injection string and the extraction string and the duration of injection since the start of the circulation phase, from the measurements made by the sensors, and verifies that this or these variables reach a predetermined target value, in which case the automatic device sends a signal to trigger an injectivity test.

BRIEF DESCRIPTION OF THE INVENTION

Figure 2:
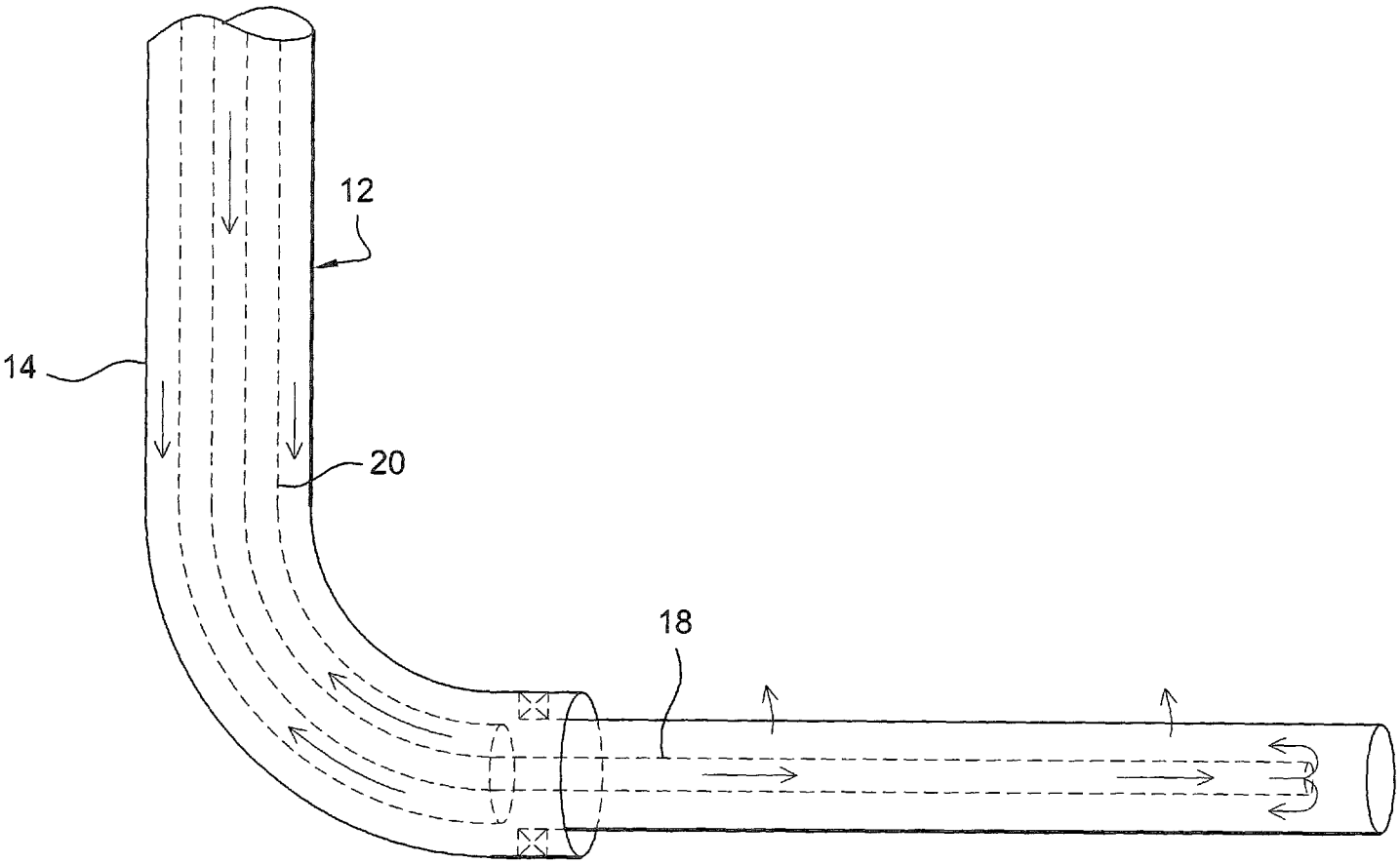

Other features and advantages of the invention will become apparent on reading the following detailed description of the embodiments of the invention, given by way of example only and with reference to the drawings which show:

FIG. 1, a diagrammatic view of a hydrocarbons production installation;

FIG. 2, a diagrammatic view of a hydrocarbons production installation with two concentric strings.

DETAILED DESCRIPTION OF THE INVENTION

A method is proposed for heating a hydrocarbon reservoir. The method comprises the provision of an installation comprising:

a first wellbore equipped with an injection string fitted with an adjustable choke and an extraction string fitted with an adjustable choke, a set of sensors, intended to measure physical variables, such as for example the pressure or the temperature, an automatic device making it possible to control and monitor the operation of the installation.

Automation makes it possible to manage more parameters.

The method also comprises the circulation of steam from one string to the other and the control of the steam injection flow rate. The automatic device optimizes the steam injection flow rate in relation to an injection flow rate target value, while still ensuring in real time that a set of physical variables, measured by sensors, or calculated from measurements made by sensors, lie within a predetermined range of values, which secures the operation of the circulation phase. For this, the automatic device acts continuously both on the choke provided on the injection string, and on the choke provided on the extraction string.

If the ranges of values defined for each of these physical variables cannot be observed, the automatic device will shut down the installation. Such an event can for example occur if the quantity of steam available in the installation is not sufficient to ensure a minimum steam flow rate.

The monitored physical variables are in particular:

- the bottom pressure in the wellbore, which is preferably below a critical threshold. This control is implemented throughout the circulation phase. The bottom pressure must be below a critical threshold such as the fracturing pressure or the squeeze pressure in order to prevent material from re-entering the string;
- a pressure variation which is more rapid than usual (slope). This variation can be an increase or a decrease;
- the steam pressure on the extraction string, measured upstream of the extraction choke. This pressure is preferably above a critical threshold, so as to monitor in particular the production of oil during the circulation phase. Also, the pressure at the head of the extraction string is preferably above a threshold pressure defined by a pressure downstream of the choke in order to prevent material re-entering the extraction string;
- the steam flow rate, measured by a sensor on the injection string, which must be above a minimum threshold, in particular in order to prevent ice from forming on the installations. In order to dispense with this limitation, additives can be added to the injected steam so as to lower this minimum threshold;
- the steam flow rate, measured by a sensor on the extraction string. This control makes it possible in particular to prevent ice from forming on the installations. In order to dispense with this limitation, additives can be added to the injected steam so as to lower this minimum threshold;
- the temperature at the injection string;
- the temperature at the extraction string.

Similarly, the automatic device can calculate certain values from the physical variables measured by the sensors, and verify that they lie within a predetermined range of values. Thus, the automatic device continuously calculates the difference between the flow rate of fluid injected at the injection string, the fluid being injected in the form of steam, and the flow rate of fluids recovered at the extraction string, and verifies that this difference lies below a critical threshold. If the critical threshold is exceeded, which can indicate a loss of steam in the reservoir, the automatic device will shut down the installation. This control is implemented particularly during the second stage of the circulation phase.

Similarly, the automatic device continuously calculates the total volume of steam injected into the injection string since the start of the steam circulation, and verifies that this physical variable is below a predetermined value. This control is implemented particularly for the triggering of the injectivity test.

Moreover, in the case where the wellbore is not equipped with a sensor of the bottom pressure in the wellbore, the automatic device continuously calculates the bottom pressure in the wellbore in relation to the pressure measured at the injection string. The term "virtual sensor" is used. Similarly, the automatic device continuously calculates the rate of development of the pressure at the injection string, and verifies that this speed is not beyond a predetermined threshold. This makes it possible to monitor the changes in the bottom pressure in the wellbore.

Similarly, the automatic device continuously calculates the difference in temperature between the injection string and the extraction string. This is also a good indicator of the loss of steam in the reservoir. This control is advantageous for triggering the injectivity test.

Similarly, the automatic device continuously calculates the difference in pressure between the pressure measured at the injection string and the pressure measured at the extraction string.

In a particular embodiment involving an upper wellbore and a lower wellbore, the physical variables from which the automatic device calculates certain values and verifies that they lie within a predetermined range can come from two different wellbores. For example, the automatic device can also continuously calculate the difference in bottom pressure between the upper wellbore and the lower wellbore.

FIG. 1 shows a reservoir 10 with a wellbore 12. The underground reservoir 10 contains highly viscous hydrocarbons. A bore comprises two parts, namely a substantially vertical part 14 and a substantially horizontal part 16. Such a bore allows drilling into the ground to reach the reservoir at depth as well as an extension within this reservoir. An elbow allows the parts 14 and 16 to be joined to each other. The bore comprises a continuous cladding on the substantially vertical part 14. The cladding of the substantially horizontal part 16 is non-continuous in the sense that the cladding has perforations allowing steam to pass to the reservoir and hydrocarbons to pass inside the wellbore.

The wellbore 12 also comprises an injection string 18 and an extraction string 20. The geometry of the strings can vary. According to the example of FIG. 1, the injection string 18 extends from the surface as far as the bottom of the wellbore; the extraction string 20 extends from the surface as far as the area around the elbow joining parts 14 and 16. The extraction string 20 is shorter than the injection string 18. Preferably, the steam is injected into the injection string 18. In fact, the loss of head for injecting the steam as far as the bottom of the wellbore 12 is less than if the steam were injected via the extraction string 20. Preferably, the extraction string 20 allows the extraction of steam-type fluid, condensed water, hydrocarbon condensates, and a mixture thereof. In fact, the loss of head for extracting the fluid via the shorter string 20 is less than if the fluid were extracted via the string 18. Due to the difference in length of the strings 18 and 20, the circulation of the steam takes place partly in the annular space surrounding the strings, in open fashion.

The injection 18 and extraction 20 strings can be concentric. This can be seen in FIG. 2. For example, the injection string 20 is inside the extraction string 18. The injection string 20 extends beyond the extraction string 18 and allows the injection of fluid at the bottom of the wellbore.

In the figures, chokes 22, 24 allow the flow rate in the strings 18 and 20 to be controlled. An injection choke 22 allows the injection flow rate into the injection string 18 to be controlled. An extraction choke 24 allows the flow rate at the outlet from the extraction string 20 to be controlled. The chokes 22 and 24 are both a calibrated port making it possible to adjust the flow rate in the wellbore. The chokes 22 and 24 have an adjustable opening, which makes it possible to precisely adjust the flow rate in the strings 18, 20. The adjustable opening of the chokes makes it possible to increase or reduce the degree of opening, which allows continuous control of the chokes. Thus, rather than opening the chokes step by step, in sequential manner, the opening or closing of the chokes is continuously controlled according to the reaction of the wellbore. This makes it possible to control and ultimately speed up the steam circulation phase.

FIG. 1 shows a second wellbore 112 comprising the same features. The features of the wellbore 112 which are the same as those of the wellbore 12 have the same reference number increased by 100. Thus, the wellbore 112 comprises a substantially vertical part 114 and a substantially horizontal part 116. A junction in the form of an elbow joins the two parts. An injection string 118 and an extraction string 120 reach into the second wellbore 112. The injection string 118 is longer than the extraction string 120. The injection string 118 extends as far as the bottom of the second wellbore 112. The shorter extraction string 120 extends as far as the elbow. Chokes 122 and 124 allow control of the flow rate in the strings 118 and 120, respectively. The same comments apply as previously.

The second wellbore 112 is situated lower in the reservoir than the first wellbore 12. The wellbores 12 and 112 are approximately 5 to 8 meters apart.

A sensor 28 of pressure in the injection string 18 can be arranged at the surface; this sensor 28 is for example arranged at the head of the string 18 downstream of the choke 22. A pressure sensor 128 can also be arranged in the same manner on the injection string 118 of the second wellbore 112.

A sensor 30 of pressure in the extraction string 20 can be arranged at the surface; this sensor 30 is for example arranged at the head of the string 20 downstream of the choke 24. A pressure sensor 130 can also be arranged in the same manner on the extraction string 130 of the second wellbore 112.

In order to measure the bottom pressure in the wellbore or wellbores 12, 112, a bottom pressure sensor can be arranged at the bottom of the wellbore or wellbores. Alternatively, in the absence of a sensor a virtual sensor can be used. This is an algorithm which, in relation to the geometry of the wellbore and of the physico-chemical properties of the reservoir, will make it possible calculate the bottom pressure in the wellbore from the pressure at the surface, measured at the injection string.

The bottom pressure depends on the reservoir and on the weight of the column of liquid in the wellbore.

It is also possible to envisage equipping the wellbore with a set of bottom pressure sensors, situated over the whole length of the drain. It is thus possible to obtain a pressure gradient along the wellbore. This provides more precise information on the pressure behaviour. Moreover, this makes it possible to continue to obtain pressure values even if one of the sensors is defective.

A flowmeter for measuring the injected and collected steam can also be arranged at the surface on each of the injection 18 and extraction 20 strings of the first wellbore 12. The same applies to each of the injection 118 and extraction 120 strings of the second wellbore 112, if appropriate. In the absence of a flowmeter, an algorithm can be used to calculate the flow rate of steam injected into each string 18, 20, 118, 120 in relation to the measured pressure and of the geometry of the string.

The installation is provided with an automatic device 11 making it possible to control and monitor the operation of the installation. In particular, the automatic device 11 is connected to the different elements of the installation. For example, the automatic device 11 can send signals to the chokes and receive signals from the sensors. For greater clarity, the connection between the automatic device and the different elements of FIG. 1 is represented by an arrow 13.

The automatic device also comprises a certain number of values parameterized by the engineer on the basis of his knowledge of the reservoir. These values are for example:

- the steam injection flow rate target value,
- the bottom pressure limit value,
- the maximum difference in temperature between the injection string and the extraction string,
- the minimum steam flow rate measured at the injection string,
- the minimum fluid flow rate measured at the extraction string,
- the minimum extraction pressure limit value,
- the minimum difference between the injection pressure and the extraction pressure,
- the maximum difference between the steam flow rate (converted into water equivalent) measured at the injection string and the fluid flow rate (converted into water equivalent) measured at the extraction string,
- the target temperature difference between the injection string and the extraction string (used for triggering the injectivity test),
- a cumulative maximum steam injection flow rate value (used for triggering the injectivity test),
- a maximum steam injection duration,
- pressure and temperature target values measured at the bottom of the wellbore in the case where the wellbore is equipped with sensors capable of providing this type of measurement,
- a fluid flow rate target value, measured at the extraction string of the producing wellbore.

If the ranges of values defined for each of the physical variables cannot be observed, the automatic device will shut down the installation. It can be provided that if one or more controlled or monitored conditions are repeatedly not met, the installation will switch to a locked shutdown state after a certain number of attempts. This helps to make the installation secure. A limit number for errors can be provided, and reaching this number will bring about a locked shutdown of the system. In this case, the automatic device actuates the closure of the injection chokes 22, 122. An unlocking action must be carried out by an authorized operator in order to allow the automatic device to reinitialize the start-up sequence.

By way of a variant, the automatic device can simply shut down the installation.

Three stages which can be carried out on the hydrocarbons production installation will now be described by way of example.

Wellbore Steaming Stage.

During this stage, steam is injected into the wellbore or wellbores 12, 112. As the walls of the string or strings are cold, the injected steam has a tendency to condense. At the start of this stage, the condensation is virtually total, and condensed water is recovered at the outlet. The release of the latent heat during the condensation of the steam heats the walls of the strings. The heat is then transmitted to the hydrocarbons formation essentially by conduction. During this stage, the risk of fracturing is very high. In fact, as the weight of the liquid column (condensed water and/or flushing liquid used during a previous stage to expel the drilling fluid) increases the bottom pressure in the wellbore, an increase in the steam injection flow rate causes a high risk of exceeding the bottom-pressure limit.

During the steaming stage, an additive can be added to the steam. This makes it possible to speed up the process, avoid the plugging of the wellbore or prevent the deposition of particles on the strings.

During this steaming stage, the automatic device acts continuously on the choke 22 of the injection string 18 so as to reach a target steam injection flow rate, ensuring that the bottom pressure in the wellbore 12 does not exceed a predetermined limit value, which can be for example the fracturing pressure, and ensuring that the steam injection flow rate measured at the injection string is above a critical value. In parallel, the automatic device acts on the choke 24 of the extraction string 20, which makes it possible to keep the extraction flow rate of the fluids, i.e. the condensed water and the hydrocarbon condensates, above a minimum value, so as to prevent ice from forming on the installations. The automatic device therefore sees to it that physical variables, which here are the steam injection flow rate, the fluids extraction flow rate and the bottom pressure, are kept within predetermined ranges. If the minimum steam injection flow rate cannot be ensured, for example because the quantity of steam available for the installation is not sufficient, the automatic device will shut down the installation.

In the particular embodiment utilizing two wellbores 12, 112 each with a horizontal part 16, 116, which corresponds to a SAGD-type configuration, the same stage is applied to both wellbores.

In a particular embodiment, it is provided to inject into the wellbore or wellbores during this stage a gas making it possible to promote the removal of the condensed water. This makes it possible, on the one hand, to dispense with the minimum steam flow rate threshold in this stage and, on the other hand, to reduce the bottom pressure in the wellbore, which makes it possible to increase the injected steam flow rate, and therefore the heating of the installations, and ultimately speed up the production of the installation.

In another embodiment, it is provided to inject a glycol-type antifreeze into the wellbore, which also makes it possible to dispense with the minimum steam flow rate threshold constraint.

In another embodiment, a pumping of the condensed water is provided, which also makes it possible to dispense with the minimum steam flow rate threshold in this stage and to reduce the bottom pressure in the wellbore.

Stage of Creating a Heat Chamber.

When the circulation in the strings assembly is mainly in the form of steam, which manifests itself in a recovery of steam in the extraction string, the heat is transmitted to the hydrocarbons formation essentially by conduction. A heat chamber 26 is created. The reservoir is thus progressively heated, and its permeability increases as a result. If the temperature of the oil in the proximity of the string increases sufficiently for the oil to become mobile, there may be a migration of the oil to the wellbore, where it starts to be produced. The steam can then enter the reservoir where it will occupy the space left by the migration of the oil. This makes it possible to transmit part of the heat by convection.

During this stage of creating a heat chamber it is desirable to control the production of liquid in the wellbore or wellbores. In fact, too great or irregular a return of liquid into the extraction string makes it very difficult to control the bottom pressure: the loss of pressure in the string depends on the ratio of steam to liquid, the hydrocarbons content of the liquid, the temperature of the liquid, the temperature of the hydrocarbons and the position of the liquid plug between the bottom and the top of the wellbore 12. When the bottom pressure becomes difficult to control, there is a risk of exceeding the pressure critical threshold.

Moreover, the liquid produced is a mixture of water and hydrocarbons, i.e. an emulsion. The presence of the emulsion in the extraction string will create very high losses of head.

During this stage of creating a heat chamber, the automatic device acts continuously on the choke 22 of the injection string 18 and on the choke 20 of the extraction string, so as to reach a target steam injection flow rate, ensuring that the physical variables monitored, in particular the bottom pressure and the pressure measured at the extraction string, lie within a predetermined value range.

Due to the absence of condensed water at the injection string and the extraction string, the steam injection flow rate can approach the target flow rate without the bottom pressure exceeding the maximum pressure threshold.

Moreover, the automatic device continuously ensures that the fluid pressure measured at the extraction string is above a threshold value. In fact if the pressure in the extraction string 20 is too low, the reservoir will feed the wellbore, which is not desirable at this stage of the process. The automatic device acts on the choke 20 of the extraction string so as to keep the extraction pressure above a threshold value. If this threshold value cannot be reached, the automatic device will switch to shutdown mode.

Moreover, the automatic device continuously calculates the difference in pressure between the injection string and the extraction string, and verifies that this difference is above a minimum threshold. In fact, a sufficient difference in pressure between the injection string and the extraction string guarantees satisfactory circulation of the steam in the wellbore, and therefore satisfactory heat transmission to the reservoir, and will ultimately make it possible to reach the production phase more rapidly.

In a particular embodiment, in order to optimize the circulation flow rate so as to have an optimum heat transmission into the deposit, a simulator can be used, which makes it possible to take other constraints into account, in particular the parameters of heat transmission into the reservoir.

Moreover, the automatic device continuously calculates the fluid flow rate between the injection string and the extraction string, and verifies that this difference is below a predetermined threshold value. If the difference in fluid flow rate is above this threshold value, the automatic device will switch to shutdown mode. In fact, a significant difference in flow rate between the injection string and the extraction string indicates that there is a loss of the steam to the reservoir, which is not desirable at this stage of the process.

In the particular embodiment utilizing two wellbores 12, 112 each comprising a horizontal part 16, 116, which corresponds to a SAGD-type configuration, the same stage is applied to both wellbores. The benefit of applying the same stage to both wellbores is that the heat chamber can be created more rapidly, which makes it possible to shorten the steam circulation phase and the start-up of the wellbore.

In the particular embodiment utilizing two wellbores each comprising a horizontal part, the automatic device continuously calculates the difference in pressure between the upper wellbore 12 and the lower wellbore 112, and verifies that this difference is comprised between a lower threshold and a upper threshold (the pressure in the wellbore 12 being above the pressure in the wellbore 112). In fact, if the difference in pressure is too great in favour of the pressure in the upper wellbore 12, there is for example a risk of fracturing of the reservoir surrounding the lower wellbore 112 and of the creation of preferential paths between the wellbores. If the difference in pressure is too small, there is a risk of hydrocarbon entry into the lower wellbore 112.

Stage of Triggering the Injectivity Test.

When the formation around the installation is sufficiently heated, the hydrocarbons can be produced. It is then desirable to stop the circulation phase in order to trigger the production phase.

The transition to the production phase starts with a so-called injectivity test stage, during which the ability of the hydrocarbons to migrate to the producing wellbore is evaluated. In particular, in the particular case where the installation provides for two parallel wellbores 12, 112, which a person skilled in the art calls the SAGD configuration, the purpose of the injectivity test is to ensure that the space between the two wellbores 12, 112 is sufficiently, and uniformly hot. In the case of the SAGD configuration, the transition to the production phase also requires the conversion of the lower wellbore into production wellbores, which involves in particular the installation of a pump and a set of sensors.

It is desirable to be able to determine the optimum moment for triggering the transition to the production phase. For this, the automatic device continuously calculates a certain number of variables, from measurements made by sensors, and verifies that these variables reach predetermined target values. If such is the case, the automatic device will emit a signal, which will allow the operator to trigger the injectivity test. Thus, the automatic device continuously calculates the difference in temperature between the injection string and the extraction string, and verifies that this difference is below a critical threshold. If the calculated value is below the critical threshold, the automatic device will emit a signal in order to trigger the injectivity test. In fact, the more advanced the circulation phase, the more the temperature of the extraction string 20 increases and the smaller the difference in temperature between the two strings.

The automatic device also continuously calculates the total volume of steam injected into the injection string since the start-up of the steam circulation. If this volume is above a predetermined value, the automatic device will emit a signal in order to trigger the injectivity test.

Finally, the automatic device continuously calculates the injection duration since the start-up of the circulation phase. If this duration is above a predetermined duration, for example 200 days, the automatic device will emit a signal, which will allow the operator to trigger the injectivity test.

In the case where the installation provides for temperature and bottom pressure sensors in the wellbore, the automatic device will continuously compare the temperature and pressure measurements emitted by the sensors with predetermined target values. If the measured values reach the target values, the automatic device will emit a signal, which will allow the operator to trigger the injectivity test In the particular case where the installation provides for two parallel wellbores 12, 112 (SAGD configuration), the automatic device also continuously measures the liquid flow rate at the outlet of the string of the producing wellbore in relation to a differential pressure between the two wellbores. If the liquid flow rate exceeds a predetermined target value, the automatic device will emit a signal, which will allow the operator to trigger the injectivity test.

If one of the criteria is satisfied the automatic device will emit a signal in order that the operator can trigger the injectivity test.

The description of the structure of the wellbore is given by way of example. It could also be envisaged that the wellbore comprises one or more injection strings combined with one or more extraction strings.

What is claimed is:

1. A method for heating a hydrocarbon reservoir, the method comprising:

providing an installation having a first wellbore equipped with an injection string fitted with an adjustable choke and an extraction string fitted with an adjustable choke, a set of sensors, intended to measure physical variables, and an automatic device making it possible to control and monitor the operation of the installation;

circulating steam from one string to the other;

controlling a steam injection flow rate in function of a target value;

keeping a set of physical variables within a predetermined range of values by continuous action of the automatic device on the choke of the injection string and on the choke of the extraction string, the physical variables including a fluid extraction flow rate, which is kept above a predetermined minimum value, and a bottom hole pressure in the first wellbore, which is kept below a bottom hole pressure critical value, the automatic device acting continuously on the choke of the injection string so as to reach a target pressure without the bottom hole pressure in the first wellbore exceeding the bottom hole pressure critical value and without the steam injection flow rate measured at the injection string being above the predetermined minimum value; and injecting steam into the first wellbore.

2. The method according to claim 1, wherein if the physical variables lie outside the ranges of values defined for each of these physical variables, the automatic device causes a shutdown of the installation.

3. The method according to claim 1, wherein the physical variables are chosen from a group consisting of: a steam flow rate measured on the injection string, a steam flow rate measured on the extraction string, a steam pressure, a temperature at the injection string, a temperature at the extraction string, and a difference between these temperatures.

4. The method according to claim 1, wherein the bottom hole pressure in the first wellbore is measured by a sensor or calculated from measurements carried out at a surface.

5. The method according to claim 4, wherein the bottom hole pressure in the first wellbore is below a fracture pressure of the reservoir.

6. The method according to claim 1, wherein the injecting steam operation comprises circulating a condensed water removal gas in the first wellbore around the strings.

7. The method according to claim 6, wherein the condensed water is pumped.

8. The method according to claim 1 further comprising:

creating a heat chamber, wherein the physical variables include a pressure measured at the extraction string, which is kept above a predetermined value.

9. The method according to claim 8, wherein the automatic device also calculates a difference between a pressure measured at the injection string and the pressure measured at the extraction string, and keeps this difference above a predetermined threshold by continuous action on the choke of the injection string and on the choke of the extraction string.

10. The method according to claim 9, wherein the automatic device also calculates a difference between a fluid flow rate measured at the injection string and a fluid flow rate measured at the extraction string, and keeps this difference above a predetermined threshold by continuous action on the choke of the injection string and on the choke of the extraction string.

11. The method according to claim 1, wherein the two strings are parallel.

12. The method according to claim 1, wherein the two strings are concentric.

13. The method according to claim 1, wherein the extraction string is shorter than the injection string and the steam is circulated from the injection string to the extraction string.

14. The method according to claim 1 further comprising:

providing a second wellbore comprising an injection string with a control choke and an extraction string with a control choke, the injection string being longer than the extraction string and the second wellbore being situated under the first wellbore in the reservoir;

calculating a difference in pressure between the bottom hole pressure in the first wellbore and a bottom hole pressure in the second wellbore;

keeping this difference between a minimum threshold and a maximum threshold by continuous action of the automatic device on the chokes of the injection strings and on the chokes of the extraction strings of the first and second wellbores.

15. The method according to claim 14 further comprising:

monitoring the meeting of at least one criterion from among: a criterion of reaching a predetermined volume of injected steam, a criterion of duration of steam injection, a criterion of bottom hole pressure in the second wellbore, a criterion of temperature, a criterion of reaching a certain flow rate of liquid in the extraction string of the second wellbore, a criterion of reaching a difference in temperature between the two strings of each wellbore and a criterion of water content of liquid produced.

16. The method according to claim 1, wherein the automatic device calculates at least one variable, from among a total volume of steam injected at the injection string, a difference in temperature between the injection string and the extraction string and an injection duration since a start of the circulating operation, from the measurements made by the sensors, and verifies that the at least one variable reaches a predetermined target value, in which case the automatic device sends a signal to trigger an injectivity test.

* * * * *